United States Patent [19]

Britt et al.

[11] 3,983,681

[45] Oct. 5, 1976

[54] APPARATUS FOR APPLYING BAG CLOSURES

[76] Inventors: John Phillip Britt, 1 Chichester Drive, Springfield, Chelmsford, Essex; Eric Henry Wilson, 32 Tabors Ave., Great Baddow, Chelmsford, Essex, both of England

[22] Filed: July 1, 1974

[21] Appl. No.: 484,992

[30] Foreign Application Priority Data

July 5, 1974 United Kingdom ..... 32195/74

[52] U.S. Cl. ..... 53/76; 53/138 A; 53/198 A

[51] Int. Cl.[2] ..... B65B 57/00; B65B 7/02

[58] Field of Search ..... 53/135, 138 A, 198 A, 53/67, 76; 29/243.56, 243.57, 211 D; 140/93 A

[56] References Cited

UNITED STATES PATENTS

| | | | |
|---|---|---|---|
| 1,673,683 | 6/1928 | Ingram | 53/138 A X |
| 2,817,840 | 12/1957 | Dennison | 29/243.57 X |
| 2,867,067 | 1/1959 | Platt | 53/198 A |
| 3,099,116 | 7/1963 | Platt | 53/138 A |
| 3,163,969 | 1/1965 | Irwin | 53/138 A X |
| 3,163,972 | 1/1965 | Irwin | 53/138 A |
| 3,190,053 | 6/1965 | Tobey | 53/138 A X |
| 3,370,396 | 2/1968 | Paxton | 53/138 A |
| 3,455,010 | 7/1969 | Busler | 53/138 A X |
| 3,621,632 | 11/1971 | Browning | 53/138 A |
| 3,648,432 | 3/1972 | Zellmer | 53/135 |
| 3,717,972 | 2/1973 | Niedecker | 53/138 A |
| 3,783,585 | 1/1974 | Hoyland | 53/198 A |

*Primary Examiner*—Othell M. Simpson
*Assistant Examiner*—John Sipos
*Attorney, Agent, or Firm*—Robert T. Gammons; Dike, Bronstein, Roberts, Cushman & Pfund

[57] ABSTRACT

Apparatus for applying to the neck of a bagged package a closure comprising stiff resilient sheet plastics material having therein a bag-neck retaining aperture communicating with an edge of the closure by means of a narrow slit, which apparatus comprises means for gathering and holding the neck of the bagged package, means for locating the closure with the slit aligned with the gathered neck, and means for effecting relative movement between the gathered neck and the closure such as to force the gathered neck through the slit and into the aperture. The holding means is a stop member which prevents advance of the bag neck until a sensor detects passage of the trailing end of the bag neck, whereupon the stop member is released and a claw advances the gathered bag neck into the closure.

16 Claims, 12 Drawing Figures

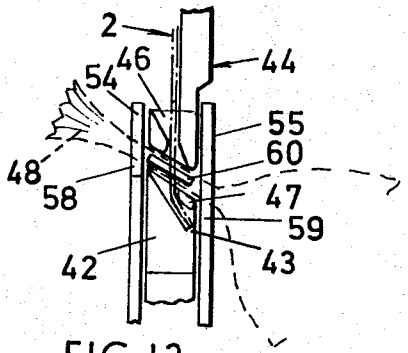
FIG. 12.
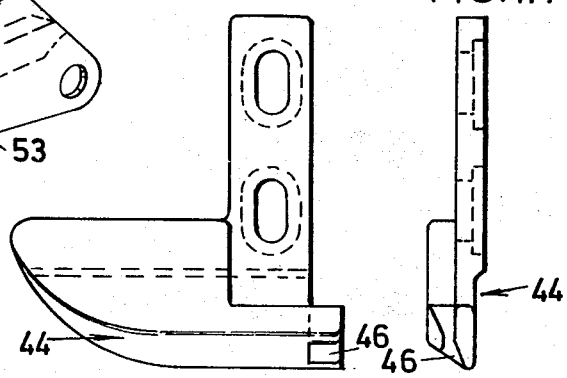
FIG. 11.
FIG. 10
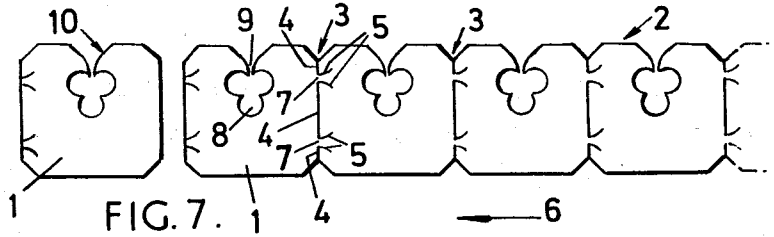
FIG. 7.
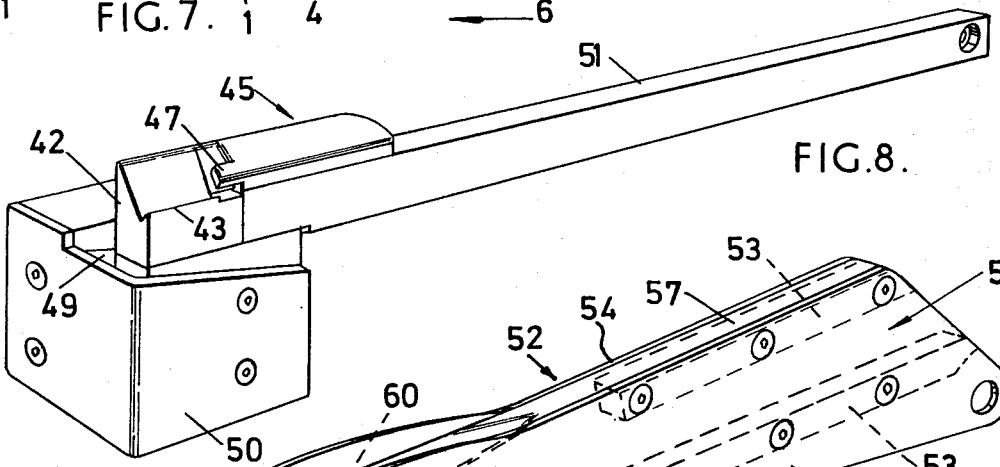
FIG. 8.
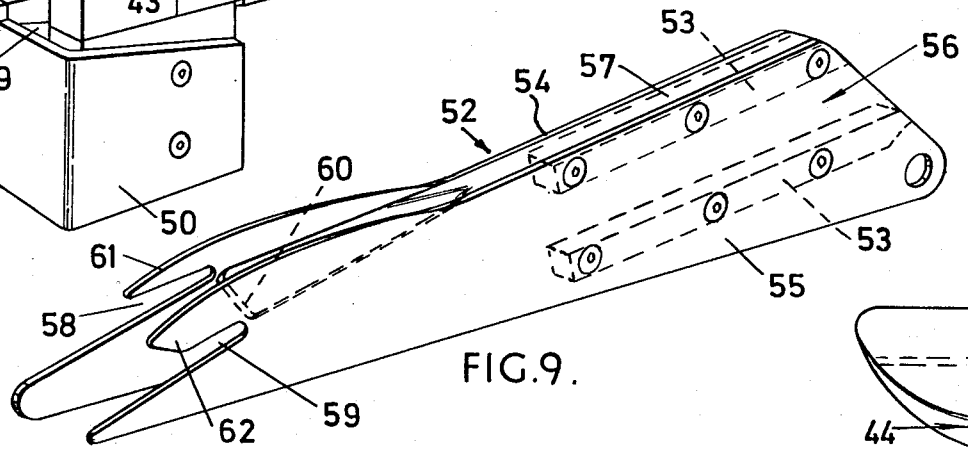
FIG. 9.

APPARATUS FOR APPLYING BAG CLOSURES

This invention relates to apparatus for applying to bagged packages closures formed of resilient stiff sheet plastics material having a bag-neck retaining aperture therein communicating with an edge of the closure by means of a narrow slit.

U.S. Pat. Nos. 3,163,969 and 3,163,972 disclose such apparatus in which the bag-neck of e.g. a polythene bag is flattened into a single plane and fed parallel to the plane progressively into the aperture of a closure aligned with the narrow slit which is located in the plane. The flattened neck thereby gathers progressively in the aperture until an entire transverse section of the neck is encircled by the closure. Provision may be made for increasing the effective width of the slit by twisting the closure about its lateral axis. A disadvantage of this known apparatus is that great care must be taken to ensure that the line of the slit is wholly in the plane of the flattened bag-neck, to prevent rumpling and tearing of the neck before the aperture is reached. Consequently the apparatus must be set up and maintained with great accuracy. These problems are especially marked if the apparatus is to be used with different sizes of bag and/or bags of different wall thickness.

It is an object of the present invention to provide apparatus in which the above-mentioned disadvantages are eliminated.

The present invention consists in apparatus for applying to the neck of a bagged package a closure comprising stiff resilient sheet plastics material having therein a bag-neck retaining aperture communicating with an edge of the closure by means of a narrow slit, which apparatus comprises means for gathering and holding the neck of the bagged package, means for locating the closure with the slit aligned with the gathered neck, and means for effecting relative movement between the gathered neck and the closure such as to force the gathered neck through the slit and into the aperture.

The relative movement may be carried out by moving the closure and/or the gathered bag-neck. In general, it is found more convenient to hold the closure stationary and feed the gathered neck into the stationary closure. The bag-neck feeding means may for example be one or more reciprocating claws which advance to force the gathered bag-neck into the closure, and then retract.

It is convenient to provide means for determining when a bag-neck has been gathered and for thereupon initiating the process of inserting the gathered neck into the closure. In the preferred arrangement, in which the closure is stationary during insertion, the presence of the gathered neck can be sensed by a stop member against which the initially flat bag neck is fed, for example by feeding wheels, in order to gather the neck. The pressure exerted by the gathered neck on the stop member can be used to push the stop member aside and initiate the feeding of the gathered neck into the closure. The stop member may be resiliently biased to the advance-preventing position with the resilient bias such that a gathered bag-neck can force the stop member to retract, retraction of the stop member actuating a trip to initiate feeding of the gathered bag-neck into the closure.

Alternatively or in addition, we may provide a neck sensor upstream of the gathering position and arranged to prevent operation of means for feeding the bag-neck into the closure until the bag-neck has passed clear of the sensor. In one particularly convenient arrangement the sensor is provided in addition to a resiliently biased stop member, and operates simply to prevent retraction of the stop member until after the bag neck has passed clear of the sensor. This arrangement enables the apparatus to handle bags of different sizes and thicknesses without adjustment of the resilient bias (for example spring tension) applied to the stop member to prevent advance of the bag-neck.

The sensor is conveniently a mechanical trip member resiliently biased to a position obstructing the path of the bag-neck and capable of being pushed aside by the bag-neck as the latter advances.

In its preferred embodiment, the present apparatus includes means for intermittently feeding an integral strip of the closures, each having its slit in a side edge of the strip, the leading end closure of the strip being applied to the bag-neck. The leading end closure may be separated from the strip before, after, or in the course of application to the bag-neck. For example, the leading end closure may be separated from the strip and then moved towards the gathered bag-neck. Preferably however, the leading end closure remains attached to, or at least in line with, the strip while the gathered bag-neck is fed into it, and the closure and inserted bag-neck are then pushed away from the strip by the bag-neck feeding means. The strip is then advanced to bring the next closure into position for application to a further bag-neck. Preferably, a guide track and end stop for the strip are provided.

In the preferred arrangement in which the gathered bag-neck is fed into a stationary closure, it is desirable to provide a backstop to prevent the closure from being pushed away by the advancing bag-neck, the backstop being automatically retracted during or after insertion of the bag-neck so that the closure and bag-neck are free to move in the direction of advance of the bag-neck. Stationary guide members may be provided for guiding the bag-neck during its advance towards the closure.

The present invention has been developed with particular reference to the packaging of bread and other bakery products in plastics bags instead of the waxed paper and other wrappings used hitherto. However, it is to be understood that the invention is applicable to the packaging of a wide range of products and a wide range of packaging materials, including plastics mesh or net and paper.

The invention will be further described with reference to the accompanying drawings, wherein:

FIG. 7 shows part of a strip of closures;

FIG. 8 shows in perspective a guide and anvil assembly;

FIG. 9 shows in perspective a claw assembly which slides on the guide and anvil assembly of FIG. 8;

FIG. 10 shows an upper clip locating member in side elevation;

FIG. 11 shows the member of FIG. 10, in end elevation; and

FIG. 12 is a detail end elevation showing the relationship between the components illustrated in FIGS. 8 to 11, a closure strip, and a bag neck, during operation.

Figure 1:
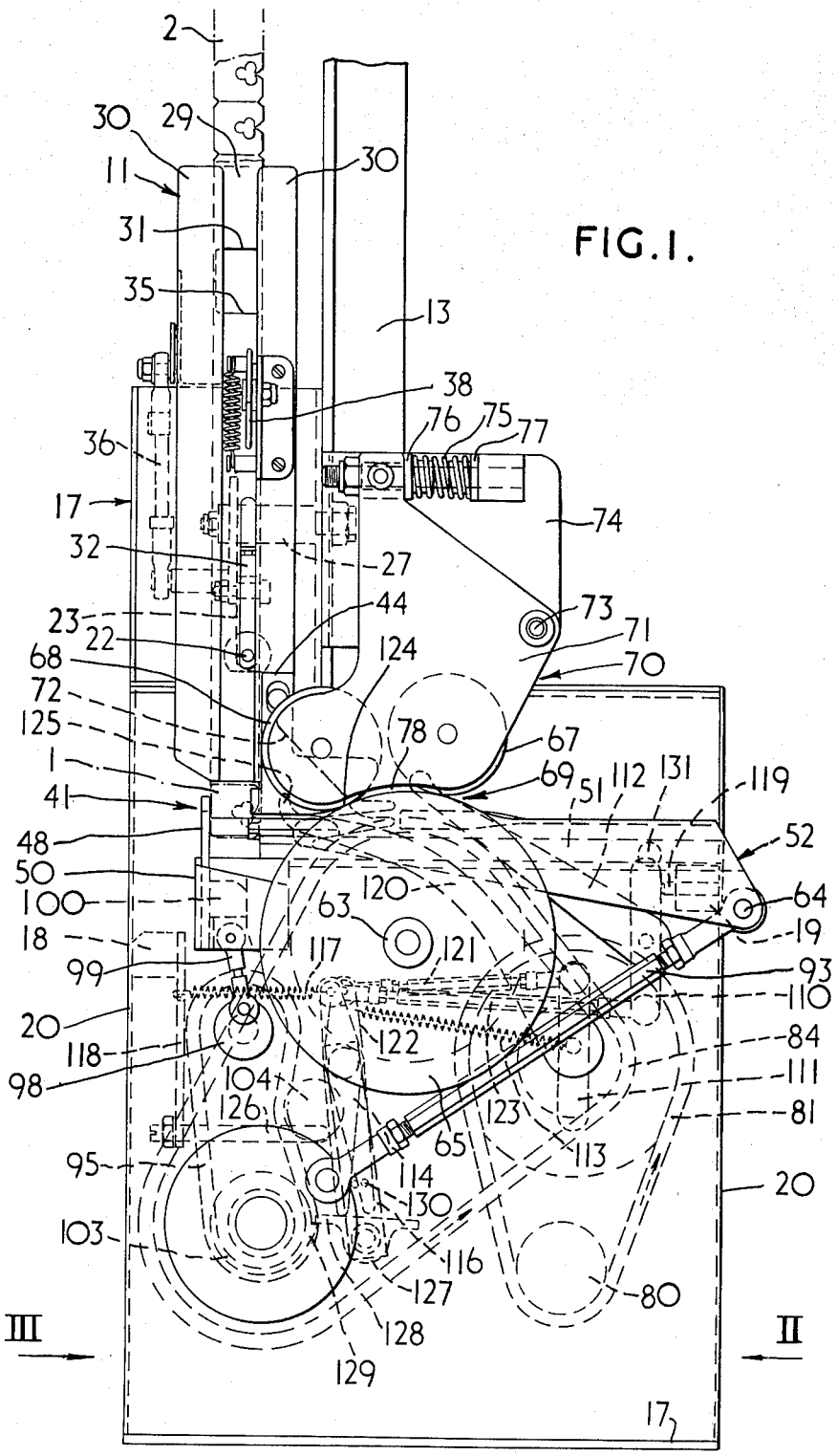
FIG. 1 is a diagrammatic side elevation of apparatus in accordance with the invention.
Figure 2:
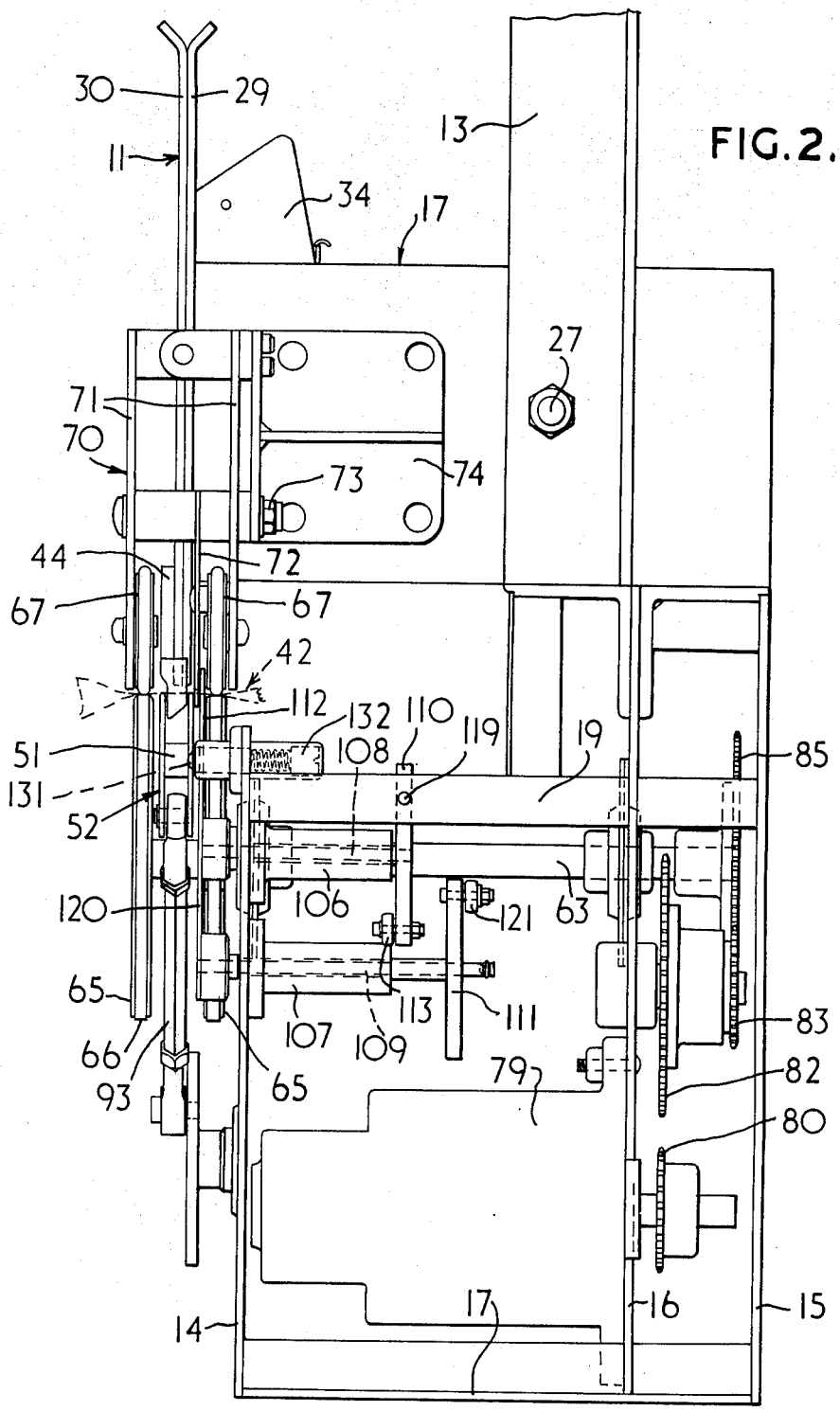
FIG. 2 is an end elevation taken along arrow II of FIG. 1.
Figure 3:
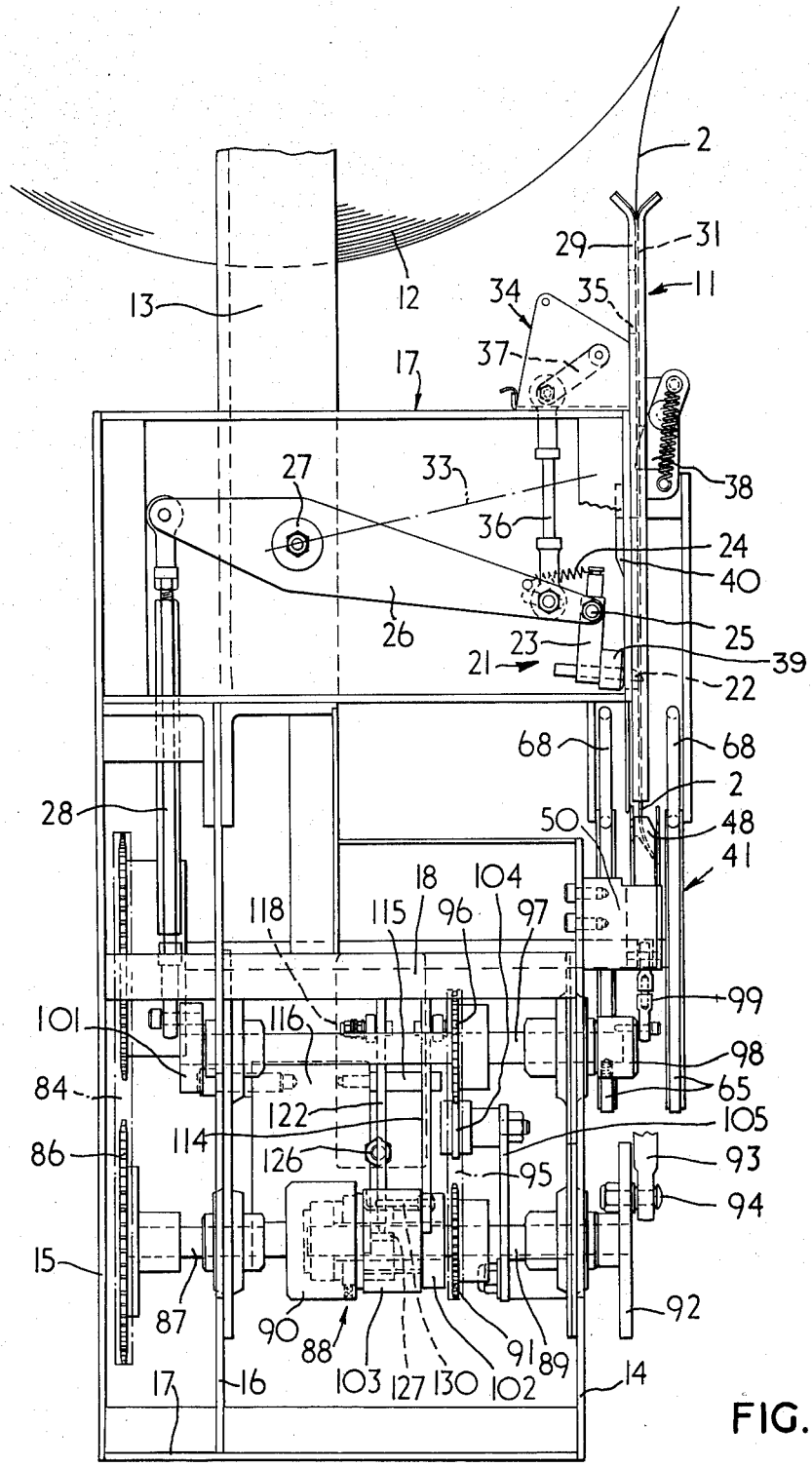
FIG. 3 is an elevation of the apparatus shown in FIG. 1, taken along arrow III.

In FIGS. 1 to 3 certain cover plates are omitted and certain components are omitted from individual Figures or shown only schematically for clarity. Also, conventional components such as bearings and fixed screws are to some extent omitted for clarity.

The apparatus illustrated is designed to apply bag closures 1 initially in the form of a strip 2 of interconnected closures with fracture planes 3 between adjacent closures whereby each closure in succession can be cleanly separated from the strip (see FIG. 7). In the preferred form of strip each fracture plane is defined by cutting through the entire thickness of the strip along three collinear portions 4 of its width without removing material from the strip, and making further cuts 5 extending from the ends of cuts 4 into the next succeeding closure; the direction of feed of the strip is shown by arrow 6. The result of this is that a force applied in the plane of, but transverse to the length of, the strip will break the narrow interconnecting webs 7 defined between pairs of cuts 5; the breaks are in line with cuts 4 and the webs 7 remain attached to the following closure. Consequently the separated closures have clean straight edges and none of the strip material is lost or wasted. The strip is made of stiff resilient plastics material e.g. polystyrene. Each closure has a bag-neck retaining aperture 8 and, in a side edge of the strip 2, a narrow entry slit 9 for insertion of a bag-neck via a tapering throat 10.

The drawings illustrate a closure-applying apparatus which comprises a vertical guide track for the stip 2 of closures. The track 11 receives the strip 2 from a roll 12 of strip carried on a spindle (not shown) mounted on a column 13.

The apparatus has a main frame which, in the illustrated embodiment, consists basically of side plates 14, 15, a partition plate 16 parallel to plates 14, 15, a bottom plate 17, and cross-bars such as 18, 19, interconnecting the plates 14 to 15 and secured thereto e.g. by screws. The upper portions of plates 15, 16, carry an upper frame or housing 17.0 on which are mounted the track 11 and column 13. End plates 20 (omitted from FIGS. 2 and 3) and other cover members are, in use, attached by screws to the main frame and upper frame or housing 17.0. Mounted in the latter adjacent the guide track 11 is a reciprocating strip-feeding device 21, FIG. 3, comprising a strip-engaging pawl 22 secured to an arm 23. Arm 23 is urged towards strip 2 by means of a tension spring 24, and pivotally coupled at 25 to a rocker 26 pivotable on a pin 27 by means of a connecting rod 28.

The track 11 is formed by a rear plate 29 and two spaced front plates 30. All three plates are grooved to form a guide channel 31 down which the strip 2 is fed. The pawl 22 projects through a slot 32, FIG. 1, in the backplate 29 so as to engage the apertures 8 of the closures, in succession. To feed the strip, the rocker 26 is rocked through an arc indicated by the chain line 33, causing the pawl 22 to disengage from the aperture 8 on its upward movement, and subsequently on its downward movement to engage the corresponding aperture 8 of the next succeeding closure, so that further downward movement of the pawl feeds the strip downwards by one closure width. A printing device 34, FIGS. 2 and 3, of any convenient construction is mounted on the housing 17.0 immediately behind the rear track plate 29 so as to print prices or other information on successive closures of the strip, through an aperture 35 provided in the plate 29. The printing mechanism is operated by the rocker 26 through a connecting rod 36 and arm 37. To prevent reverse movement of the strip, a spring-loaded pawl 38 is mounted on one front plate 30 to engage the apertures 8 of successive closures. In order to operate the printing mechanism, the throw of the rocker 26 is greater than that necessary to transfer the pawl 22 from one to the next closure aperture 8. Accordingly the pawl 22 is lifted out of engagement from the closure strip during the upper part of its travel, by means of a disc 39 mounted on the pawl which engages tapered guide members 40 mounted on each side of the upper portion of the slot 32.

Immediately below the bottom of the channel 31 is a closure-locating station 41 into which the leading end closure of the strip is fed and is located while a previously gathered bag-neck, indicated schematically at 42 in FIG. 2, is fed into the closure through its slit 9.

Details of the closure-locating station 41 can be seen in FIG. 8 and FIGS. 10 to 12. The leading edge of the closure engages an anvil 42 with a steeply pitched upper surface terminating at its lower edge in an end stop 43 which limits the downward movement of the strip. The leading edge of the closure is therefore forced to the right as seen in FIGS. 3 and 12. To receive those portions of the closure on opposite sides of its entry slit, there are upper and lower guide members 44, 45. The upper guide member 44 is mounted at the bottom of the track 11 and has a projection extending into the path of the closure edge containing the entry slit, in which projection is a guide slot 46 with a tapered entry. The member 45 has a corresponding projection 47 so arranged that the leading portion of the closure will pass below the projection 47 as it is being twisted by the anvil 42. The walls of the slot 46 provide lateral restraint to hold the upper part of the closure vertical and prevent its separation from the strip. The projection 47 provides restraint accentuating the twist produced by the anvil 42. The effect of this twist is to separate the jaws of the closure which define the entry slit, in order to facilitate insertion of a bag-neck 42.

A backstop 48 (FIGS. 1 and 3) can slide vertically in a slot 49 adjacent to the end of the anvil 42 remote from the guide member 45. The slot 49 is defined by an angled end plate 50 to which the anvil is attached and which is in turn attached in any convenient way to the main side plate 14. The guide and anvil assembly shown in FIG. 8 is completed by a rectangular guide bar 51 colinear with the guide member 45 and anvil 42. The free end of the guide bar 51 is also attached to the side plate 14 by means of a screw, a spacer being interposed between the guide bar and the side plate 14 so that the guide bar is spaced from the parallel to the side plate. The bar 51 carries and guides a reciprocatable feed claw assembly 52 shown in perspective in FIG. 9.

The feed claw assembly is composed of a pair of slide bars 53 spaced vertically and secured between a pair of side plates 54, 55 so as to define an elongate slot 56 which fits around the bar 51. Screwed to the top of the upper bar 53 is a top strip 57.

At its end adjacent to the locating station 41, each plate 54, 55 is formed with a claw recess 58, 59 facing the locating station. The apex of the recess 58, as seen in end view, is higher than that of the recess 59. The top strip 57 has its end 60 adjacent to these apexes and the end portion of the strip 57 is twisted so as to extend obliquely from one said apex to the other. The claws 61, 62 defined by the recesses 58, 59, and the apexes of these recesses, stand above the guide bar 51 as can be seen in FIG. 1. The upper edge of each plate 54, 55 above the recess and adjacent region is a circular arc.

The claw assembly can be reciprocated by means of the connecting rod 93 pivoted to it at 64 along the guide bar 51 from the retracted position shown in FIG. 1 to an end position in which the claws pass on respective sides of the anvil and the end 60 of the top strip passes between the guide members 44, 45 and into the slit and aperture of the closure located on the anvil. The guide members 44, 45 have, at least in the region adjoining the anvil, spaced parallel oblique surfaces, pitched less steeply than the surface of the anvil and parallel to the strip end 60 as can be seen in FIG. 12. The strip end 60 serves as a striker for detaching the end closure from the strip 2 after a bag-neck has been fed into the closure aperture by the claws as will be described below.

A shaft 63 journalled in bearings mounted on the plates 14, 16 carries a pair of spaced parallel bag-neck feed wheels 65 each provided with a rubber tyre 66. The claw assembly passes between the upper parts of the wheels 65. In the retracted position, the part-circular upper edges of the claws are aligned with the upper edges of the tyres 66.

Each wheel 65 is in frictional engagement with a pair of successive idle wheels 67, 68 also provided with rubber tyres. The wheels 67 and 68 form sucessive nips with the wheels 65, for feeding forward a bag-neck 42 fed in a substantially flat condition to the nip 69 between the wheels 65, 67, as will be described below.

The wheels 67, 68 form part of an idler assembly 70 comprising side plates 71 and an intermediate guide plate 72, the assembly being pivoted at 73 on a bracket 74 attached to the upper housing 17.0. The assembly 70 is urged anti-clockwise (as seen in FIG. 1) by a compression spring 75 acting between respective seats 76 on the assembly 70 and 77 on the bracket 74, so that the wheels 67, 68 are pressed firmly against the wheels 65. The lower edges of the plates 71, 72 in the region between the successive nips are contoured in a part-circular arc concentric with but of greater radius than the wheels 65 and the upper edges of the claws, to form a narrow horizontal channel 78 along which the bag-neck is fed in a flattened condition.

For driving the apparatus, an electric motor 79 is mounted on the plate 16 and is provided with a drive sprocket 80 which through a chain 81 (FIG. 1) drives a chain wheel 82 rotatably mounted on a stub shaft secured to the plate 16. The chain wheel 82 is fast with a sprocket 83 which through a chain 84 (FIG. 1) drives a chain wheel 85 fast with the shaft 63 so that the bag feed wheels 65, 67 and 68 are driven continuously.

The chain 84 also drives a chain wheel 86, FIG. 3, fast with a shaft 87 journalled in bearings mounted on the plate 16. The shaft 87 through a clutch 88 drives a shaft 89 journalled in the clutch input member 90 and in bearings mounted on the plate 14. The shaft 89 carries a sprocket 91 and a crank disc 92 to which the lower end of the connecting rod 92 is pivotably attached by a pin 94. The sprocket 91 through a chain 95 drives a sprocket 96 fast on a shaft 97 journalled in bearings in the plates 14, 16. One end of the shaft 97 projects through the plate 14 and carries a crank block 98 with an eccentric pin connected by a pivotable link 99 to a block 100 fastened to the lower end of the backstop 48. The other end of the shaft 97 is connected by an eccentric disc 101 and pin to the lower end of the connecting rod 28.

The clutch 88 comprises the input member 90, an output member 102 fast with the shaft 89, means for coupling these members together, and a control sleeve 103 which when restrained from rotation in a predetermined direction disengages the clutch and, when free to rotate, allows the clutch to become engaged. Such clutches are well known and therefore will not be described in detail. A jockey wheel 104 for tensioning the chain 95 is mounted rotatably on a spring-loaded arm 105 pivotably mounted on the plate 14.

The plate 14 carries a pair of internal bearing sleeves 106, 107 in which are journalled respective shafts 108, 109 each having secured at the internal end a respective rocker 110, 111. The end of shaft 108 which projects outside the plate 14 carries a trip finger 112 whose upper end projects alongside the plate 72 at the nip 69. The lower end of the rocker 110 is connected by a rod 113 to the upper end of a stop lever 114 which is pivoted at an intermediate point on a pin 115 secured in a rectangular mounting block 116 rigidly attached to the plate 16. The upper end of the stop lever 114 is connected by a tension spring 117 to a plate 118 screwed to the crossbar 18. The plate 118 is shown in phantom only in FIG. 3 so as to reveal the internal mechanism more clearly. The tension of the spring 117 biases the trip finger 112 to its uppermost position as shown in FIG. 1, this position being defined by a stop screw 119 threaded in the crossbar 19.

The projecting outer end of the shaft 109 is fast with a stop finger 120. The upper end of the rocker 111 is connected by a connecting rod 121 to the upper end of the trip lever 122 mounted alongside the lever 114 on the pin 115. A tension spring 123 connects the upper end of the trip lever 122 to the shaft 109, thereby biassing the finger 120 to the raised position shown in FIG. 1. The upper end of the finger 120 is curved sharply upwards and in the raised position is spaced slightly downstream of the nip 124 between wheels 65 and 68, to form a stop 125 for a bag-neck fed through the channel 78. The top limit position of the finger 120 is defined by a stop screw 126 threaded in the plate 118.

The lower end of the lever 122 adjoins the surface of a trip rocker 127 pivoted on a pin secured in the mounting block 116. A projecting arm 128 of the rocker 127 normally engages a shoulder 129 of the clutch control sleeve 103, thereby preventing rotation of the control sleeve and holding the clutch disengaged. Downwards movement of the finger 120 will pivot the lever 122 so that the arm 128 can lift and release the shoulder 129, whereupon the clutch will become engaged.

The lower end of the lever 114 carries a stop pin 130 which projects adjacent to that edge of the lever 122 remote from the clutch coupling sleeve 103. When the finger 112 is in its raised position as shown in FIG. 1, the pin 130 is spaced from the edge of the lever 122 which can therefore pivot to release the rocker 127 and engage the clutch. When the finger 112 is depressed, the stop pin 130 is moved to engage the said edge of the lever 122. Consequently the lever 122 cannot pivot to release the rocker 127 and the stop 125 is held positively in its raised position.

Figure 4:
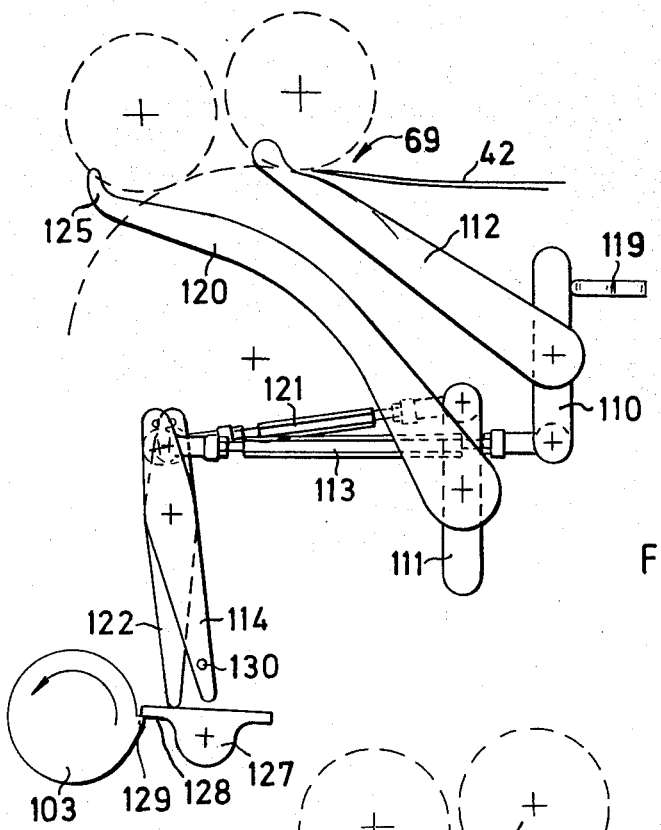
FIGS. 4 to 6 illustrate successive stages in the operation of a trip mechanism.
Figure 5:
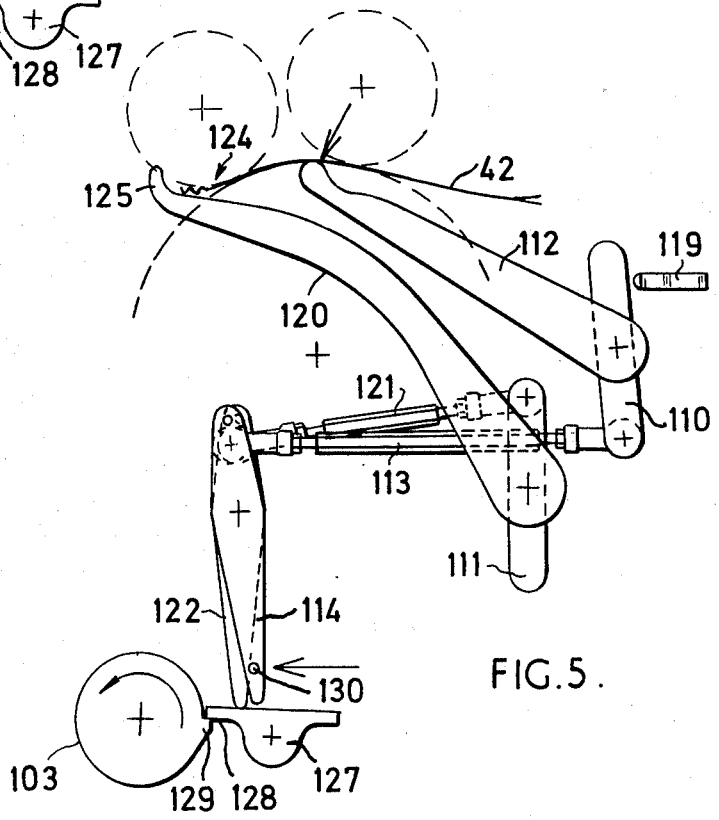
Figure 6:
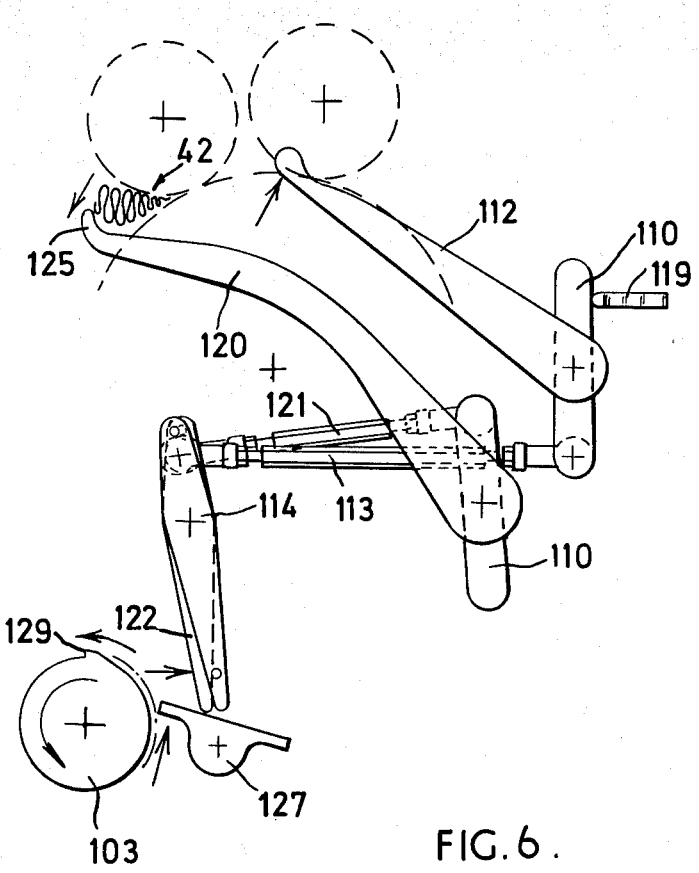

The operation of the apparatus will now be described with especial reference to FIGS. 4 to 6.

In use, the apparatus described is mounted on or alongside a conveyor carrying the bags which are to be closed, which bags have previously been filled with the appropriate product, for example loaves of bread. In the case of loaves of bread, the bags will in general consist of polythene. The relation between the apparatus and the conveyor is such that the open bag-neck, loose or roughly flattened, overlies the claw assembly and is advanced by the conveyor into the nip 69 as shown in FIG. 4.

At this stage, the apparatus is in the condition shown in FIGS. 1 to 4, with the wheels 65, 67 and 68 rotating but the other components stationary. Both fingers 112 and 120 are raised. The leading edge of the bag neck 42 is gripped in the nip 69 and drawn forwards at a speed greater than that of the conveyor, pushing aside the finger 112 so that the stop pin 130, as shown in FIG. 5, is moved to engage the lever 122. The leading edge of the bag-neck is then fed in a flattened condition along the channel 78 into the nip 124 and on emerging from the latter comes into contact with the raised stop 125 on the finger 120. The latter is held in its raised position by the pin 130, since the finger 122 is still held down by succeeding portions of the bag-neck passing through the nip 69, as shown in FIG. 5, and consequently the leading edge of the bag-neck cannot advance. Consequently, the bag-neck becomes gathered in the region defined between the nip 124 and the stop 125, being additionally guided by the spaced oblique surfaces of the members 44, 45. The clutch 88 remains disengaged.

When the trailing edge of the bag-neck has passed clear of the finger 112, the latter rises under the tension of the spring 117 and accordingly the pin 130 moves away from the lever 122. The gathered bag-neck is now exerting substantial pressure on the stop 125, and therefore pushes the latter aside, depressing the finger 120 against the action of the spring 123, and pivoting the lever 122 anti-clockwise as seen in FIGS. 1 and 4 to 6. The rocker 127 thereupon tilts under the pressure exerted by the shoulder 129, and the control sleeve 103 is thereby released so that the clutch 88 becomes engaged.

The following cycle of operations now takes place automatically by virtue of the drive transmitted through the now engaged clutch. During the first 116 degrees of revolution of the clutch, the eccentric disc 92 and connecting rod 93 advance the claw assembly rapidly along the slide bar 51 from the position shown in FIG. 1, in which the claws do not obstruct the path of the bag-neck, through the region downstream of the nip 124 where the gathered bag-neck is, to a position in which the bag-neck, now held in the claw recesses, enters the tapered portion 10 of the closure. As already mentioned, the apex of the recess 58 is higher than that of the recess 59. Because of this and the oblique guide surfaces of the members 44, 45, the bag-neck as it is being fed forward by the claws is slightly twisted, the twist being in the direction opposite that in which the closure is twisted by the anvil, as can be seen in FIG. 12. This further twist imparted to the bag-neck facilitates its entry into the closure.

A further 7 degrees of revolution of the clutch produces further advance of the claws, pushing the bag-neck completely into the aperture of the clip. Throughout this part of the cycle, the backstop 48 has been progressively retracted through the eccentric block 98 and link 99, and it now moves clear of the rear edge of the closure, which it previously held against movement under the pressure exerted by the bag-neck being forced into the closure. During the next 8 degrees of revolution, the end 60 of the top strip 57 enters the slit of the clip and the lateral pressure thereby exerted on the slip, in the absence of the backstop 48, breaks the clip from the strip 2 and pushes the clip and bag-neck clear of the locating station, the thus closed bag being conveyed away in a convenient manner. The full feed stroke of the claw assembly occupies 200° of revolution of the clutch, the claw assembly being returned to its starting position during the remainder of the single clutch revolution.

As soon as the gathered bag-neck has been moved clear of the stop 125, the lever 122 returns to its initial position under the tension of the spring 123 (the finger 112 being now in its raised position), and thereby holds down the rocker 127 so that when the clutch has completed one revolution the shoulder 129 is again restrained and the clutch is disengaged. To eliminate the effects of play in the clutch mechanism, the initial and final position is defined by a detent comprising a pin 131 projecting under spring loading from a sleeve 132 mounted in the plate 14, the end of the pin engaging a hole or recess provided in the claw side plate 54 when the claw assembly is in its initial and final position.

During the first half revolution of the clutch, the rocker 26 is pivoted to its upper position 33, causing the printing mechanism 34 to print a closure through the window 35. During the second half revolution the rocker 26 descends, causing the pawl 22 to advance the strip by one closure, to replace the closure just broken off by the end 60 of the top strip 57 acting as a striker. The whole apparatus then returns to its initial condition, illustrated in FIGS. 1 to 4.

In certain circumstances, and in particular if the apparatus is to be used only with bags of a single size and thickness, the finger 112 and associated components can be omitted. With such an arrangement, the spring 123 is made strong enough to hold the stop 125 up until the bag-neck has been fully gathered, but the spring will extend under the force exerted by the gathered bag-neck, together with the forward traction exerted on the bag by the conveyor, so as to push aside the stop 125 and thereby engage the clutch, initiating the operating cycle already described.

It will be seen that the gathered bag-neck is at all times restrained, by the stop 125, the claw recesses, and the members 44, 45, so that the gathers cannot spring apart.

It has been found that the arrangement described, in which the bag-neck is gathered before being inserted in the closure, requires less precise alignment and is less likely to cause damage to the bag-neck than the known apparatus in which the bag-neck is fed in a flat condition into the aperture of the closure and gathers in the aperture.

Only one preferred embodiment of the apparatus has been described and illustrated, but many modifications may be made in accordance with the invention.

Thus, the apparatus need not be mounted vertically alongside a package conveyor, but may be mounted in any orientation depending upon existing packaging arrangements. For instance, the apparatus may be arranged horizontally above the conveyor for packages standing upright on the conveyor. Similarly, the overall compactness of the apparatus enables it to be moved bodily past the package, if it is so desired, rather than vice versa, while, if the package is only partly filled and with a long neck, there may be no need to move the package past the machine, since the closure applying operation of the apparatus is not dependent on such movement, but will operate if both are stationary.

Similarly, the closure applying cycle of the apparatus may be triggered by any other known method, such as photo-electric detectors, or microswitches, rather than by the use of a mechanical trip. Furthermore, the closure may be forced on to the bag-neck while the latter is being held stationary, or both may be forced together.

The apparatus of the invention may be used to apply closures to the necks of bags of a wide range of packaging materials. Suitable materials include plastics film, such as polyethylene, polypropylene, and polyvinylidene chloride, cellulose film, plastics netting (e.g. "Netlon"), paper, woven or knitted fabrics such as hessian and cheese cloth, metal foils and laminates.

We claim:

1. Apparatus for applying to the neck of a bagged package a closure comprising, a stiff resilient sheet plastics material having therein a bag neck retaining aperture communicating with an edge of the closure by means of a narrow slit, which apparatus comprises means for feeding the bag neck along a predetermined path in a predetermined forward direction, a forwardly displaceable stop member disposed in said path against which the bag neck is adapted to be gathered and held by the stop member, locating means for supporting the closure downstream of the stop member with the slit aligned with and spaced from the gathered neck, claw means for engaging the gathered neck, and actuating means for effecting forward movement of the claw means to and beyond the stop member to displace the stop member to an out of the way position and to force the gathered neck thru the slit and into the aperture.

2. Apparatus according to claim 1, wherein the feeding means comprises, at least one pair of neck feed wheels forming a nip, at least one of said wheels being driven for feeding between the wheels of a bag neck supplied to the nip, and the stop member is downstream of the nip to prevent advance of the bag neck whereby the latter is gathered in engagement with the upstream side of the stop member.

3. Apparatus according to claim 2, wherein the stop member is resiliently biased to its advance preventing position, the resilient bias being such that a bag neck when gathered can force the stop member to move to its out of the way position, and including trip means responsive to such movement for initiating forward movement of said claw means.

4. Apparatus according to claim 3, including a continuous drive means coupled to the driven feed wheel or wheels for rotating the feed wheels continuously and a clutch arranged to couple the continuous drive means to the means for effecting said forward movement of the claw means, said clutch being normally disengaged and said trip means being arranged to effect clutch engagement in response to displacement of the stop member.

5. Apparatus according to claim 1, including a bag neck sensor upstream of the stop member and arranged to prevent operation of said claw means until the bag neck has passed clear of the sensor.

6. Apparatus according to claim 1, comprising a bag neck sensor upstream of the stop member and arranged to prevent forward movement of the stop member to said out of the way position until the bag neck has passed clear of the sensor.

7. Apparatus according to claim 6, wherein said sensor is a mechanical trip member resiliently biased to a position obstructing the path of the bag neck and capable of being pushed aside by a forwardly moving bag neck.

8. Apparatus according to claim 7, wherein said claw means is provided with a striker member arranged to apply a lateral force to the leading end closure after the bag neck has fully entered the closure aperture, thereby to separate said leading end closure from the strip.

9. Apparatus according to claim 7, wherein the locating means includes an end stop for the strip.

10. Apparatus according to claim 1, wherein the locating means includes a backstop for preventing movement of the closure in the direction of forward movement of the gathered bag neck and there is means provided for automatically retracting the backstop so that when the bag neck has fully entered the aperture the closure is free to move in said direction.

11. Apparatus according to claim 1, including stationary guide members for guiding the gathered bag neck during its forward movement.

12. Apparatus as claimed in claim 1 in which the closure-locating means is shaped to impart to the closure located thereby a twist such as to open the slit of the closure.

13. Apparatus as claimed in claim 1 including means for intermittently feeding to the closure-locating means an integral strip of said closures with the slits of the closures in a side edge of the strip, and wherein the said means for effecting relative movement is arranged to separate the leading end closure from the strip.

14. Apparatus for applying to the neck of a bagged package a closure comprising, a stiff resilient sheet plastics material having therein a bag neck retaining aperture communicating with an edge of the closure by means of a narrow slit, which apparatus comprises, means for feeding the bag neck along a predetermined path in a predetermined forward direction, a forwardly movable stop member yieldably resistant to displacement disposed in said path against which the bag neck is adapted to be gathered by said feeding means, said yieldably resistant stop member being movable forwardly to a position out of said path by movement of the gathered bag neck forwardly in said predetermined direction, locating means for supporting the closure downstream of the stop member in the path of movement with the edges of the closure defining the slot spaced transversely in opposite directions with respect to the plane of the closure such as to present a gap facing the forwardly moving gathered neck, a forwardly movable claw means situated upstream of the stop member movable forwardly towards the stop member into engagement with the gathered neck against the stop member and means for effecting forward movement of the claw means toward and beyond the stop member to displace the stop member to said out of the way position and to introduce the gathered neck into the gap between the laterally displaced edges of the closure.

15. Apparatus according to claim 12 in which the claw member embodies two transversely spaced elements arranged side by side containing bag neck receiving recesses located at different levels such as to twist the gathered neck in a direction opposite to the twist imparted to the closure.

16. Apparatus for applying to a bag neck a closure of stiff resilient plastics sheet material having therein a bag neck retaining aperture communicating with an edge of the closure by way of a narrow slit, said closures being provided in the form of a strip of closures integral with and separable from one another and having their said slits in a side edge of the strip, which apparatus comprises, means for locating the leading end closure of the strip in a predetermined position with its said slit facing in a first direction, a guide track for guiding the strip to the locating means, a strip feed mechanism for feeding the strip along the guide track, bag neck feed wheels arranged to receive a bag neck and to feed it towards the locating means, a stop member disposed between the neck feed wheels and the locating means and resiliently biased to a position preventing advance of the bag neck towards the leading end closure whereby a bag neck fed by the wheels will become gathered in the region between the feed wheels and the stop member, at least one claw open towards the locating means in the direction opposite said first direction, and actuating means for reciprocating the claw or claws along a path from a retracted position clear of the bag neck path, through the said region, to a position overlapping the locating means whereby the claw or claws on advancing will engage a bag neck gathered in said region and force said gathered bag neck through the slit and into the aperture of the leading end closure, and move the closure away from the strip, driving means continuously coupled to the feed wheels and to a clutch, the clutch being normally disengaged and being in driving connection with the strip feed mechanism and the claw actuating means, and trip means responsive to movement of the stop member away from its advance preventing position and arranged to effect engagement of the clutch in response to such movement and automatically to disengage the clutch after a predetermined movement thereof thereby to perform successive single operating cycles each comprising movement of the stop member by the gathered bag neck, advance of the claw or claws along their said path, retraction of the claw or claws and feeding of the strip to engage the next closure thereof with the locating means.

* * * * *